US010328598B2

(12) United States Patent
King

(10) Patent No.: US 10,328,598 B2
(45) Date of Patent: Jun. 25, 2019

(54) SLICING MACHINES, KNIFE ASSEMBLIES, AND METHODS FOR SLICING PRODUCTS

(71) Applicant: URSCHEL LABORATORIES, INC., Chesterton, IN (US)

(72) Inventor: Daniel Wade King, Valpariso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 15/275,361

(22) Filed: Sep. 24, 2016

(65) Prior Publication Data

US 2017/0087735 A1 Mar. 30, 2017

Related U.S. Application Data

(60) Provisional application No. 62/222,932, filed on Sep. 24, 2015.

(51) Int. Cl.
*B26D 7/26* (2006.01)
*B26D 3/26* (2006.01)
*B26D 7/06* (2006.01)

(52) U.S. Cl.
CPC ..... *B26D 7/2614* (2013.01); *B26D 3/26* (2013.01); *B26D 7/0691* (2013.01); *B26D 2210/02* (2013.01)

(58) Field of Classification Search
CPC ..... B26D 7/2614; B26D 3/26; B26D 7/0691; B26D 2210/02
See application file for complete search history.

(56) References Cited

U.S. PATENT DOCUMENTS 4,523,503 A * 6/1985 Julian ..... B26D 1/03 83/403
4,590,835 A * 5/1986 Matsuo ..... B26D 1/03 83/403
5,095,875 A * 3/1992 Morris ..... B26D 1/0006 83/403

(Continued)

FOREIGN PATENT DOCUMENTS

WO 20130101621 7/2013

OTHER PUBLICATIONS

International Search Report and Written Opinion; PCT/US2016/053677, dated Dec. 15, 2016.

*Primary Examiner* — Sean Michalski
(74) *Attorney, Agent, or Firm* — Hartman Global IP Law; Gary M. Hartman; Domenica N. S. Hartman

(57) ABSTRACT

Methods and equipment suitable for slicing products into lattice-type slices or chips. The methods and equipment utilize a knife assembly that includes a corrugated knife having oppositely-disposed surfaces that terminate at a cutting edge. The knife assembly further includes a knife holder having a registration surface and an oppositely-disposed knife seat configured to mated with a first surface of the corrugated knife, and means for securing the knife to the knife seat of the knife holder. The knife seat comprises a pattern of peaks and valleys complementary to a pattern of peaks and valleys in the first surface of the corrugated knife. The securing means cooperates with the knife holder to inhibit accumulation of solids of products along at least one of the first and second surfaces of the corrugated knife, and/or stabilizes the knife by reducing a cantilevered beam length thereof.

29 Claims, 10 Drawing Sheets

(56) References Cited

U.S. PATENT DOCUMENTS

| | | | | |
|---|---|---|---|---|
| 5,819,628 | A * | 10/1998 | Cogan | B23D 35/008 83/403 |
| 6,928,915 | B2 * | 8/2005 | Jensen | B26D 1/03 241/84 |
| 7,117,778 | B2 * | 10/2006 | Fein | B26D 1/0006 30/353 |
| 8,714,068 | B2 * | 5/2014 | Ornelaz, Jr. | B26D 7/2614 83/403 |
| 8,844,416 | B2 * | 9/2014 | Walker | B26D 1/0006 83/402 |
| 9,193,086 | B2 * | 11/2015 | Jacko | B26D 7/2614 |
| 9,469,041 | B2 * | 10/2016 | King | B26D 1/03 |
| 2004/0079213 | A1 | 4/2004 | Jensen et al. | |
| 2010/0236372 | A1 * | 9/2010 | Desailly | B26D 1/0006 83/857 |
| 2015/0140198 | A1 * | 5/2015 | Rawlings | B26D 1/03 426/637 |
| 2017/0197323 | A1 * | 7/2017 | Rawlings | B26D 3/26 |
| 2017/0225348 | A1 * | 8/2017 | Jacko | B26D 7/0691 |

* cited by examiner

SLICING MACHINES, KNIFE ASSEMBLIES, AND METHODS FOR SLICING PRODUCTS

CROSS REFERENCE TO RELATED APPLICATIONS

This application claims the benefit of U.S. Provisional Application No. 62/222,932, filed Sep. 24, 2015, the contents of which are incorporated herein by reference.

BACKGROUND OF THE INVENTION

The present invention generally relates to methods and machines for cutting products, including but not limited to food products. The invention particularly relates to machines equipped with a cutting head and an impeller assembly adapted to rotate within the cutting head, wherein the impeller assembly transports products to knives situated in the cutting head for slicing the products into slices or chips of the lattice type.

Various types of equipment are known for slicing, shredding and granulating food products, as nonlimiting examples, vegetables, fruits, dairy products, and meat products. Widely used machines for this purpose are commercially available from Urschel Laboratories, Inc., and include machines under the names Model CC® and Model CCL. The Model CC® and CCL machines are centrifugal-type slicers capable of slicing a wide variety of products at high production capacities. Whereas the Model CC® line of machines is particularly adapted to produce uniform slices, strip cuts, shreds and granulations, the Model CCL line is particularly adapted to produce slices or chips of a waffle or lattice type (hereinafter, collectively referred to as a lattice), nonlimiting examples of which are represented in FIG. 1.

From top to bottom, the images in FIG. 1 represent fine, coarse, and deep lattice cuts, which may be used to produce, as nonlimiting examples, lattice potato chips and potato waffle fries. As evident from FIG. 1, the opposing surfaces of the slices are characterized by a periodic pattern having a corrugated or sinusoidal shape with rounded peaks and valleys when viewed edgewise, though sharper peaks and valleys are also possible. The lattice cut is produced by sequentially crosscutting a product at two different angles, typically ninety degrees apart, using one or more knives each having a cutting edge formed to have the desired periodic pattern of the slices to be produced. Such a knife is referred to herein as a corrugated knife, which is intended to denote the presence of a cutting edge on the knife that is characterized by peaks and valleys when the knife is viewed edgewise, but is not restricted to cutting edges having peaks and valleys with any particular shape or pattern, periodic or otherwise.

Original versions of the Model CCL are represented in U.S. Pat. Nos. 3,139,127 and 3,139,130, whose contents are incorporated herein by reference. A representation of a Model CCL machine 10 is shown in FIG. 2, and drawings of a Model CCL machine 10 adapted from U.S. Pat. Nos. 3,139,127 and 3,139,130 are included herein as FIGS. 3 through 5. The machines 10 depicted in FIGS. 2-5 include a frame 12 that supports a power unit 14, a stationary cutter assembly (cutting head) 16, and a carriage or conveyor (impeller) assembly 18 that is rotatably disposed within the cutting head 16 for feeding products to the cutting head 16. The cutting head 16 and impeller assembly 18 are coaxial, and the cutting head 16 remains stationary while the impeller assembly 18 rotates within the cutting head 16 about their common axis. The cutting head 16 and impeller assembly 18 are enclosed in a housing 20, and products are delivered to the cutting head 16 and impeller assembly 18 through a feed hopper 22. FIG. 4 represents a perspective view of the machine 10 of FIG. 3, with the hopper 22 retracted and the housing 20 and cutting head 16 removed to expose the impeller assembly 18, which is represented as having four tubular guides 24 that deliver products to the cutting head 16. FIG. 5 is an isolated top fragmentary view of the cutting head 16 and impeller assembly 18, and shows corrugated cutting knives 26 mounted at the perimeter of the cutting head 16, each secured to a segment 28 of the cutting head 16 between a knife holder 30 and clamp 32. The assemblage of a knife 26, knife holder 30, and clamp 32 forms what will be referred to herein as a knife assembly 34. From FIG. 3, it is evident that the interior of the cutting head 16 has a spheroidal surface. Consequently, the knives 26, knife holders 30, and clamps 32 also have spheroidal shapes.

The hopper 22 delivers products to the impeller assembly 18, and centrifugal forces cause products to move outward into engagement with the interior spheroidal surface of the cutting head 16, including the interior surfaces of the knife holders 30. The interior surfaces of the knife holders 30 are referred to herein as registration surfaces of the knife holders 30. While engaged with the registration surfaces, in regular succession the products encounter and are sliced by the knives 26 circumferentially spaced within the cutting head 16.

FIG. 6 represents a fragmentary perspective view of a cutting head 16 and impeller assembly 18 corresponding to the machine 10 shown in FIG. 5. FIG. 6 is useful for further describing operating principles of the Model CCL. Product delivered to the feed hopper (not shown) enters the impeller assembly 18 at ①. The impeller assembly 18, including its four rotating tubular guides 24, rotates about the vertical axis shared with the cutting head 16. Centrifugal forces urge products 35 within the tubular guides 24 radially outward through the tubular guides 24 toward the radially outward extremities ② thereof. The tubular guides 24 are driven to rotate about their respective axes so that the product 35 within each guide 24 is rotated about its horizontal axis while the impeller assembly 18 rotates about its vertical axis. As centrifugal forces hold the products 35 tightly against the spheroidal interior surface of the cutting head 16, the tubular guides 24 cause the products 35 to make an approximate one-quarter turn between each of four knife stations ③, resulting in the desired lattice cut being generated in slices 36 as the knives 26 are encountered.

FIG. 7 is an isolated perspective view of a cutting head 16 of a CCL machine 10 corresponding to the machine 10 shown in FIGS. 5 and 6. The cutting head 16 is again shown as comprising segments 28 that define the spheroidal interior surface of the cutting head 16, and corrugated cutting knives 26 secured to each segment 28 between a knife holder 30 and clamp 32. FIG. 8 evidences the curvature of a knife 26, knife holder 30, and clamp 32. As evident from FIGS. 7 and 8, the knife holder 30 defines a knife seat 44 that has a smooth cylindrical surface on which a knife 26 of essentially any shape can be placed. Likewise, the knife clamp 32 has a simple arc on its leading (clamping) edge to clamp the knife 26 against the knife holder 30. The clamp 32 visible in FIG. 7 can be seen to have a tapered outer surface 32*a* at its leading edge (generally conical as a result of the arcuate shape of the clamp 32) to gently direct slices up and over the clamp 32 as they leave the cutting head 16. As evident from FIG. 8, the peaks and valleys of the knife 26 and simple arcuate shapes of the knife holder 30 and clamp 32 result in the presence of gaps or openings 38 between the knife 26 and both the knife holder 30 and clamp 32.

Further descriptions pertaining to the construction and operation of Model CCL machines are contained in U.S. Pat. Nos. 3,139,127 and 3,139,130.

CCL machines of the types described above have performed exceedingly well. Even so, as is apparent from FIG. 8, as products and slices pass over the knife holder 30 and clamp 32, a portion of the product and slice may scrape the leading edges of the holder 30 and clamp 32. Over time, the openings 38 between the shaped knife 26, knife holder 30 and clamp 32 may accumulate solids, for example, starch if the product being sliced is a vegetable or fruit. Though such accumulation does not pose an issue with well-maintained machines, if unattended the accumulated solids may eventually lever the knife 26 off the knife seat 44 of the knife holder 30, resulting in the production of thinner slices. If, as a result, the knife 26 is no longer rigidly registered against the knife seat 44 of the knife holder 30, the leading (sharp) edge of the knife 26 can become destabilized, diminishing slice accuracy and quality. Another issue that may be encountered is that, due to the dual rotary nature of the slicing action on a CCL machine, i.e., products rotating about the horizontal axis of the tubular guides 24 while also rotating about the vertical axis of the impeller assembly 18, the knives 26 may experience a force that is transverse to the slicing force that occurs in a roughly horizontal direction. Over time, this transverse force may result in vertical movement of the knives 26 (i.e., parallel with the axis of rotation of the impeller assembly 18), indicated by the arrow 40 in FIG. 8. These circumstances may become exacerbated by increasing the amplitude of the peaks and valleys of the knives 26, for example, the coarse and deep lattice cuts in comparison to the fine lattice cut depicted in FIG. 1.

BRIEF DESCRIPTION OF THE INVENTION

The present invention provides methods and equipment suitable for slicing products into slices or chips of the lattice type.

According to one aspect of the invention, a knife assembly of a slicing machine adapted to slice products includes a corrugated knife having oppositely-disposed surfaces that terminate at a cutting edge. The cutting edge and at least portions of the first and second surfaces adjacent thereto are characterized by a pattern of peaks and valleys. The knife assembly further includes a knife holder having a registration surface and an oppositely-disposed knife seat configured to mated with a first surface of the corrugated knife, and means for securing the corrugated knife to the knife seat of the knife holder. The knife seat comprises a pattern of peaks and valleys complementary to the pattern of peaks and valleys in the first surface of the corrugated knife. The securing means contacts the second surface of the corrugated knife and cooperates with the knife holder to inhibit accumulation of solids of products along at least one of the first and second surfaces of the corrugated knife, and/or stabilizes the corrugated knife by reducing a cantilevered beam length thereof.

The securing means may comprise a member having fingers and notches therebetween that define a pattern complementary to the pattern of peaks and valleys in the second surface of the corrugated knife, with the fingers thereof engaging the valleys on the second surface of the corrugated knife. In some nonlimiting embodiments, the member may be a clamp that directly secures the knife to the knife holder, and in further nonlimiting embodiments the member may be an adapter that, along with the knife, is secured by a clamp to the knife holder.

Other aspects of the invention include machines and methods for cutting products using knife assemblies of the type described above to produce slice products. Such a machine or method delivers products to a perimeter of a cutting head through action of rotating an impeller assembly and a delivering means associated therewith, and slicing the products with a corrugated knife to produce slices or chips of a lattice type.

Technical effects of knife assemblies, methods and machines described above preferably include the ability of the securing means to reduce or eliminate openings resulting from the peaks and valleys of a corrugated knife. In so doing, the securing means is able to reduce the accumulation of solids that might eventually lever the knife off the knife seat of its holder and result in the production of thinner slices and/or lead to knife instability. Consequently, the securing means is capable of addressing various potential quality issues, including slice accuracy and variation, and therefore reduce scrap, improve yields, etc.

Other aspects and advantages of this invention will be better appreciated from the following detailed description.

DETAILED DESCRIPTION OF THE INVENTION

FIGS. 9A, 9B, 10, and 11 represent knife assemblies and components thereof suitable for use with machines having certain features similar to the machines 10 represented in FIGS. 2 through 7, and in some instances may be a modification or retrofit of such a machine 10. In particular, nonlimiting embodiments of the invention will be illustrated and described hereinafter in reference to a machine having components arranged as described for the machine 10 in FIGS. 2 through 7, though it will be appreciated that the teachings of the invention are more generally applicable to a variety of machines. Furthermore, though the knife assemblies and components represented in FIGS. 9A, 9B, 10, and 11 will be discussed in reference to slicing food products, it should be understood that the knife assemblies, as well as cutting heads, impeller assemblies, and machines to which they may be assembled, can be utilized to cut other types of products.

Figure 8:
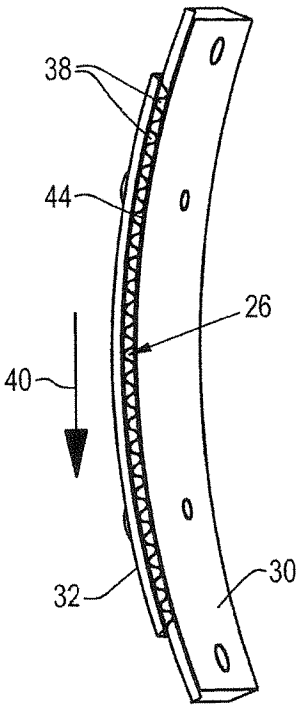
FIG. 8 is an edge view of a knife assembly of the cutting head of FIG. 7, and depicts the relative cross-sectional shapes of a knife holder, a knife clamp, and a knife secured therebetween.

The knife assemblies and knife assembly components represented in FIGS. 9A, 9B, 10, and 11 are configured to reduce or eliminate potential issues previously discussed in reference to FIG. 8 as arising from the presence of openings 38 between the corrugated knife 26 and the simple arcuate shapes of the knife holder 30 and/or clamp 32 visible in FIG. 8. In so doing, the knife assemblies and knife assembly components are further capable of addressing certain undesirable consequences of the openings 38, for example, the incidence of scraping between product, product slices, and the leading edges of the holder 30 and clamp 32, the accumulation of solids within the openings 38, the levering of the knife 26 off the knife seat of the knife holder 30 that leads to the production of thinner slices, destabilization of the leading (cutting) edge of the knife 26, and vertical movement of the knife 26 (arrow 40 in FIG. 8), i.e., parallel with the axis of rotation of the impeller assembly 18.

Figure 9B:
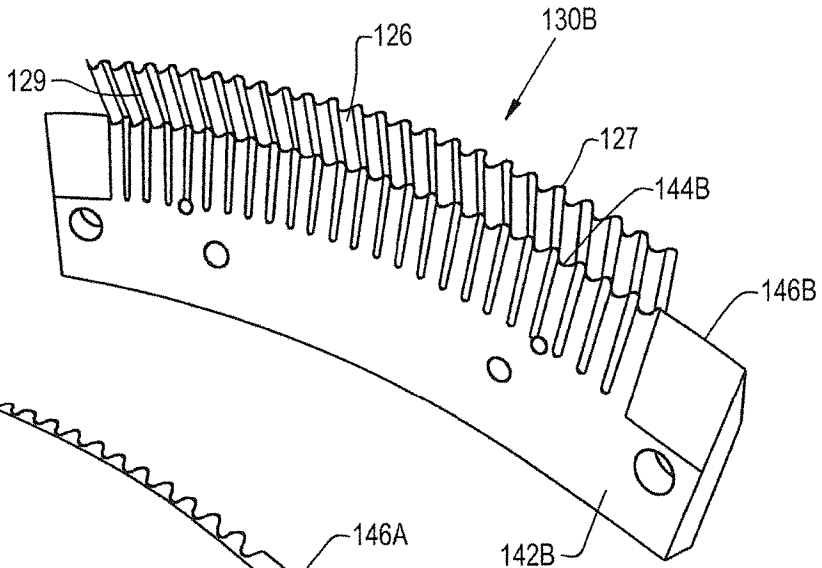
FIGS. 9A and 9B are perspective views of two versions of knife holders suitable for use with the machines and components thereof represented in FIGS. 2 through 7, wherein the knife holder of FIG. 9A has a knife seat having a periodic pattern complementary to a corrugated knife, and the knife holder of FIG. 9B has a knife seat having a periodic pattern complementary to a corrugated knife mated therewith, and an oppositely-disposed registration surface having a periodic pattern similar to that of the corrugated knife.
Figure 9A:
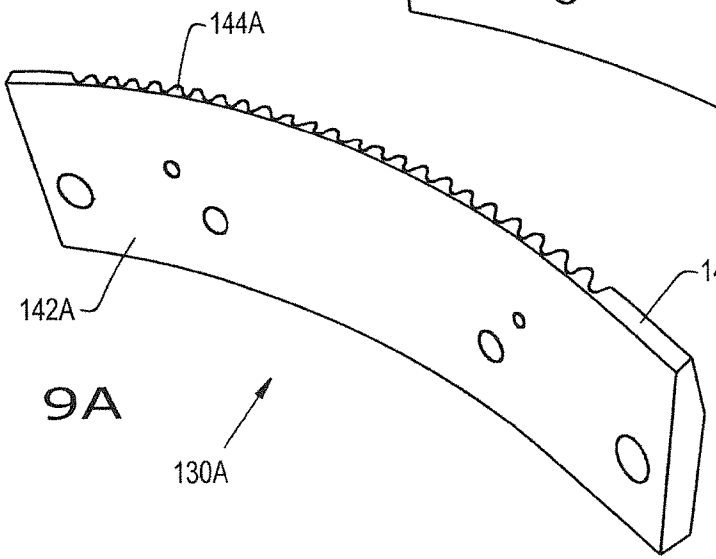

FIGS. 9A and 9B are perspective views of two versions of knife holders 130A and 130B. Each knife holder 130A and 130B is configured for assembly with a corrugated cutting knife, for example, the corrugated knife 126 shown mated with the knife holder 130B of FIG. 9B, so that a leading portion of the knife 126 that defines a cutting edge 127 projects beyond a leading edge 146A or 146B of the holder 130A and 130B, for example, as depicted in FIG. 9B. As previously noted, the knife 126 is considered to be "corrugated" as a result of its cutting edge 127, as well as at least adjacent portions of oppositely-disposed surfaces 129 and 131 of the knife 126 that terminate at the cutting edge 127, being characterized by peaks and valleys when the knife 126 is viewed edgewise. As also previously noted, knives within the scope of the invention are not restricted to any particular shape or pattern of peaks and valleys. Each knife holder 130A and 130B is configured for assembly with a clamp, as nonlimiting examples, either of two clamps 132A and 132B shown in FIGS. 10 and 11, for the purpose of clamping the corrugated knife 126 to the holder 130A and 130B. A knife assembly (as a nonlimiting example, the knife assembly 134 shown in FIG. 11) is formed by clamping a knife to either knife holder 130A and 130B with either clamp 132A and 132B.

Figure 1:
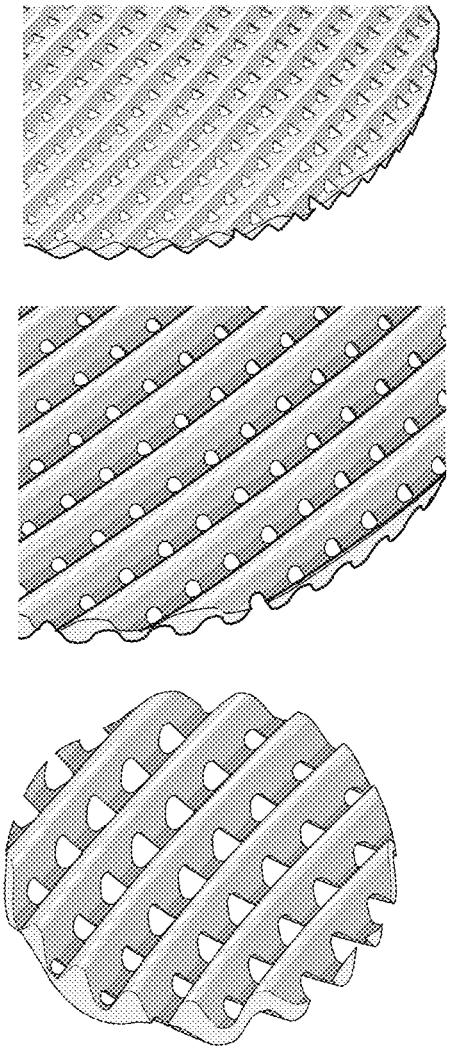
FIG. 1 schematically represents lattice-type slices that may be produced with machines and components of the types represented in FIGS. 2 through 8.
Figure 2:
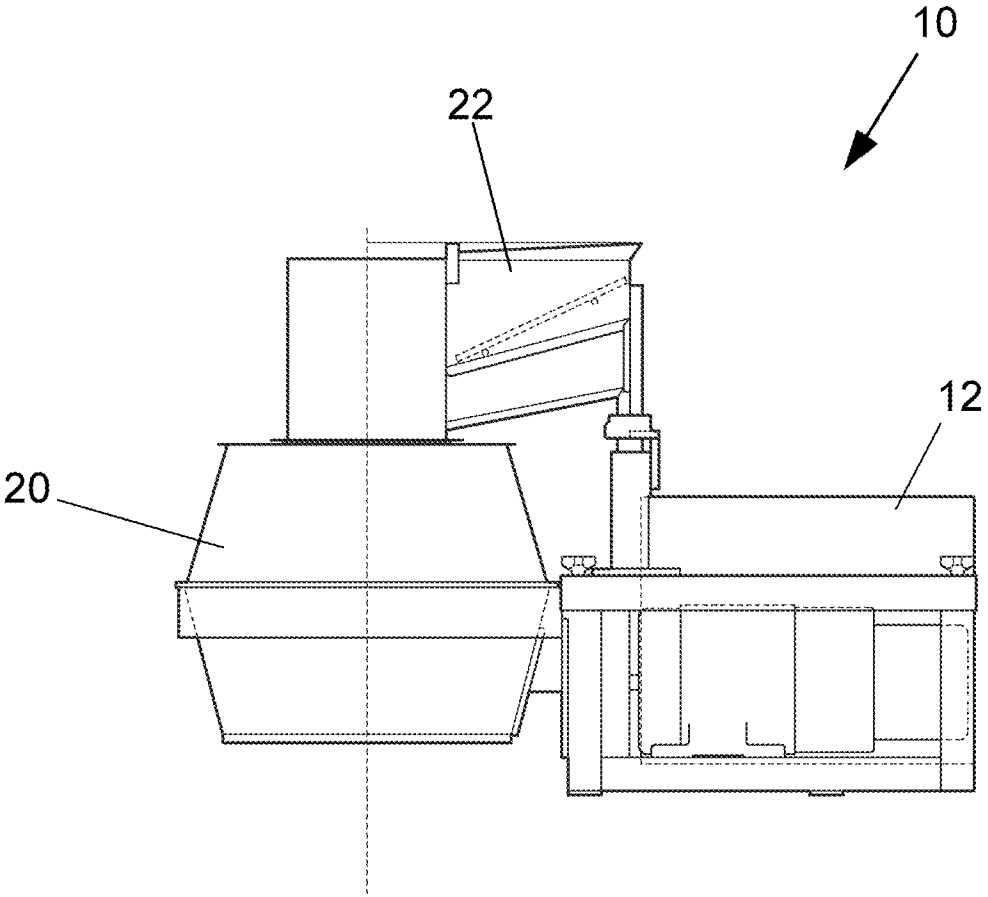
FIG. 2 is a side view representing a Model CCL machine known in the art.
Figure 3:
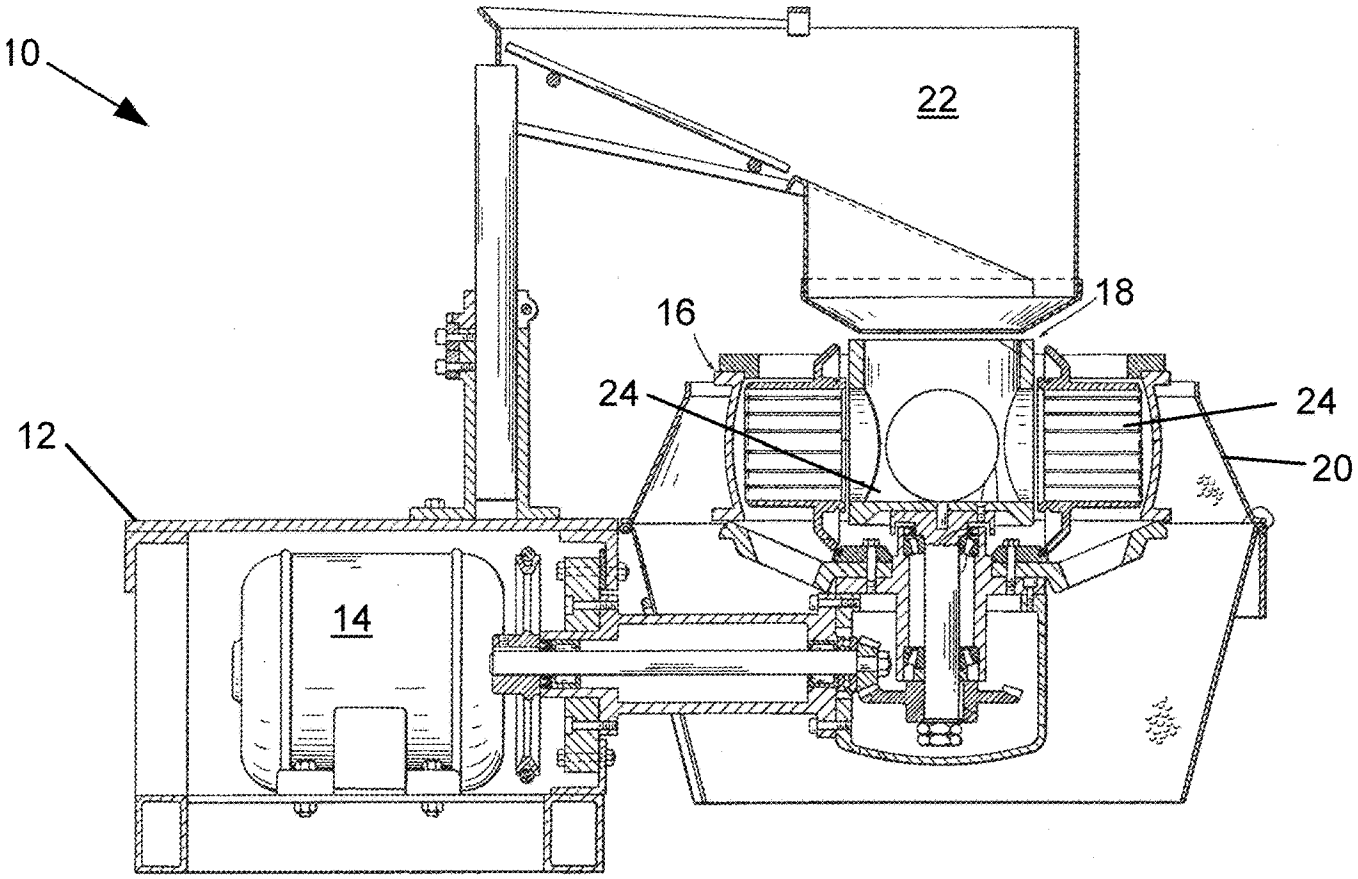
FIG. 3 is a side view in partial cross-section of a Model CCL machine.
Figure 4:
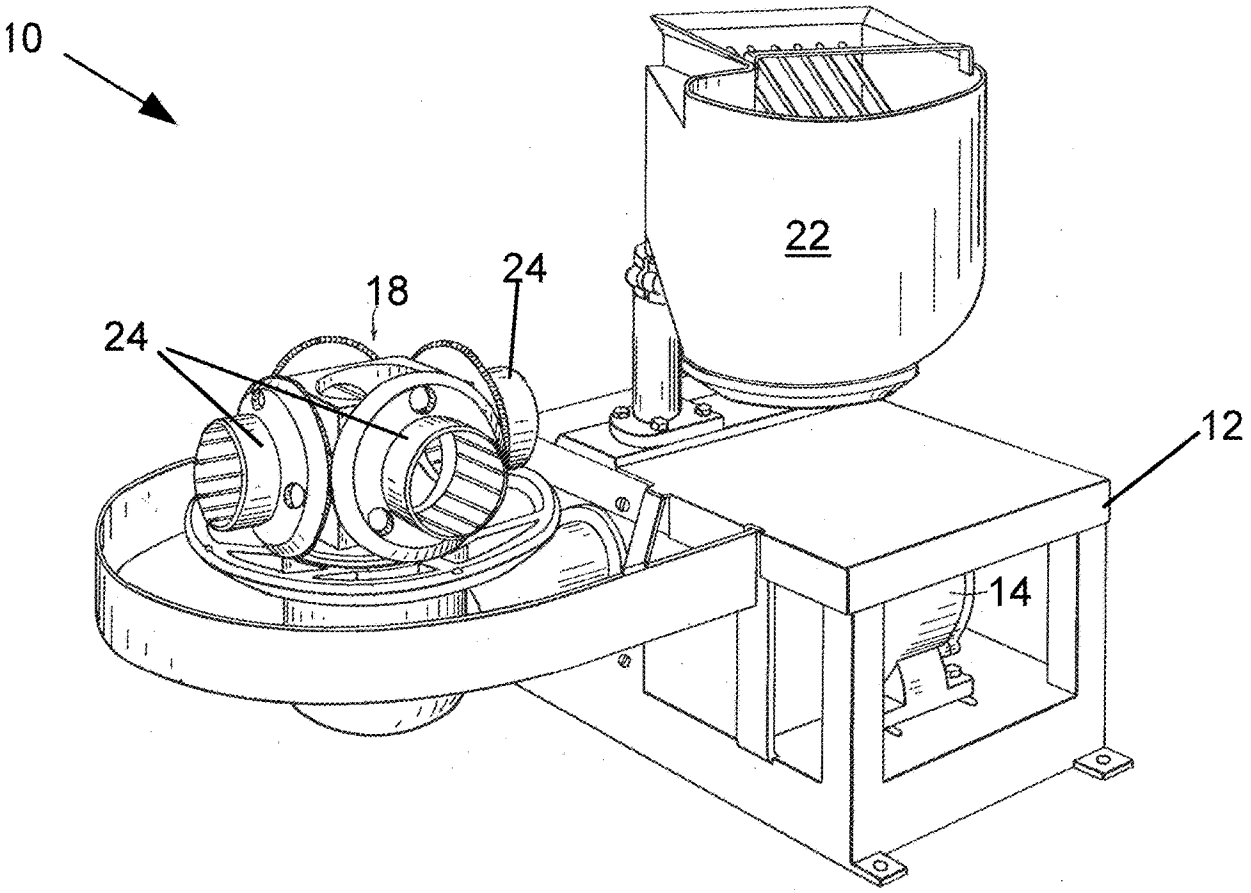
FIG. 4 is a perspective view of the machine of FIG. 3, with a housing and cutting head removed to expose an impeller assembly.
Figure 5:
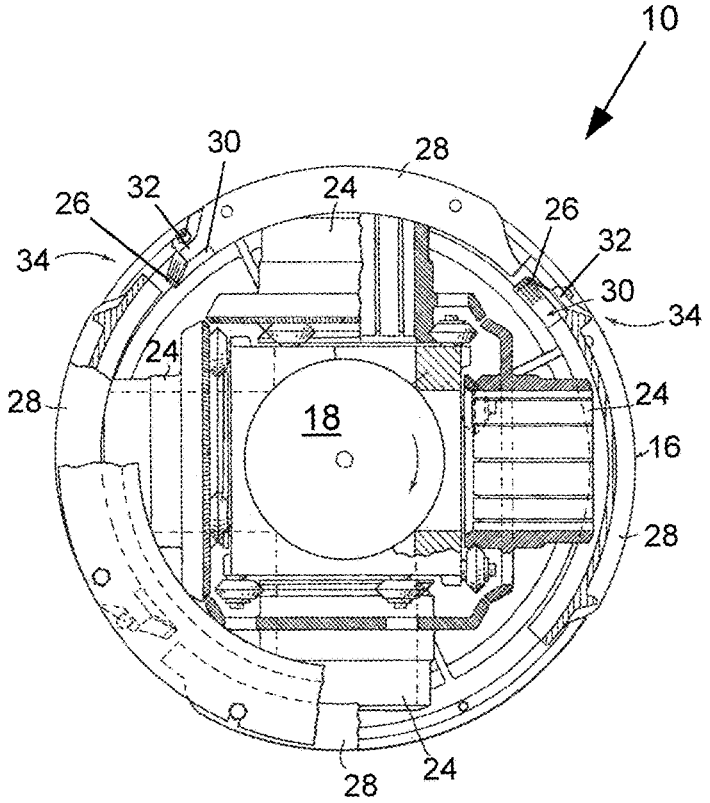
FIG. 5 is a top fragmentary view of the cutting head and impeller assembly of the machine of FIG. 3.
Figure 6:
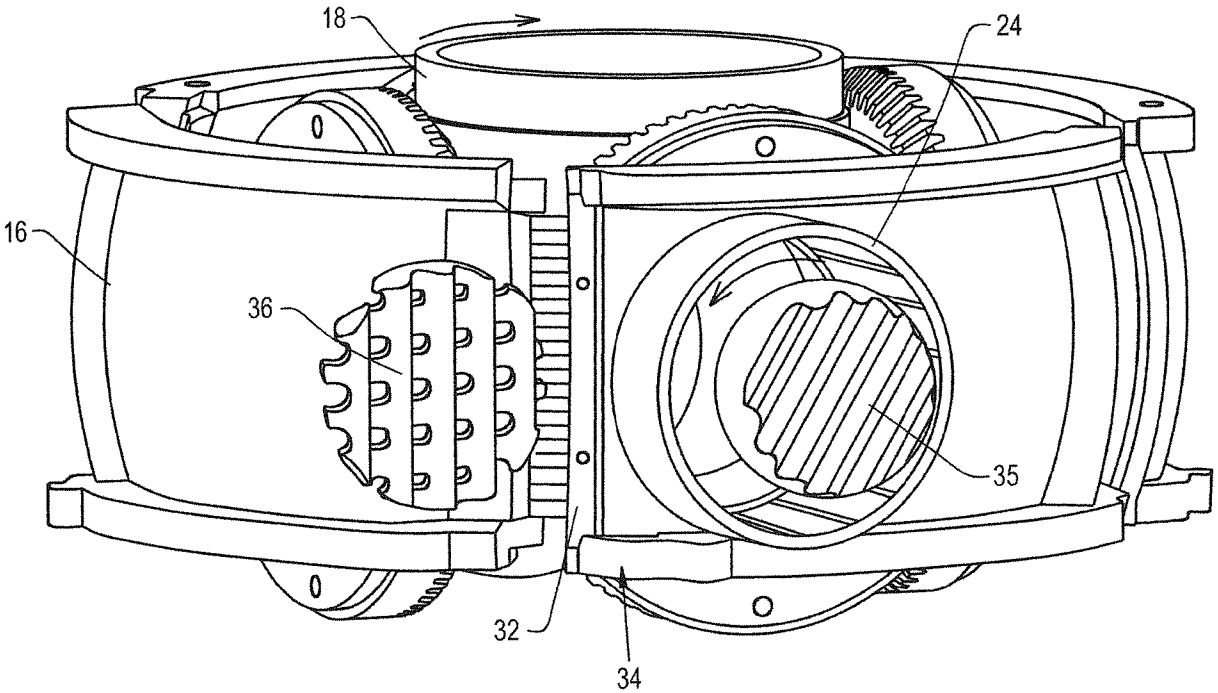
FIG. 6 is a perspective view of a cutting head and impeller assembly of a Model CCL machine.
Figure 7:
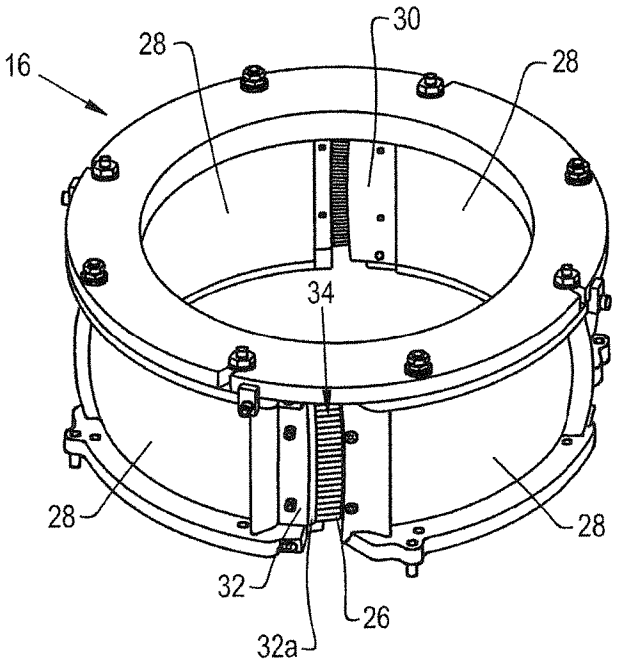
FIG. 7 is a perspective view representing the cutting head of FIG. 6.

The knife holder 130A of FIG. 9A has a registration surface 142A formed to have a simple arcuate shape similar to that of the knife holder 30 seen in FIGS. 5, 7, and 8. The knife holder 130A further has a knife seat 144A that is opposite its registration surface 142A and formed to have a pattern of peaks and valleys complementary to peaks and valleys of a corrugated knife to be mated thereto, for example, the knife 126 shown mated with the knife holder 130B of FIG. 9B. Similarly, the knife holder 130B of FIG. 9B defines a knife seat 144B formed to have a pattern of peaks and valleys complementary to the peaks and valleys in the surface 129 of the corrugated knife 126 with which it is mated. The knife seats 144A and 144B are preferably configured to substantially or entirely fill the openings or gaps between the knife 126 and the knife holders 130A and 130B that would otherwise result from the valleys in the surface 129 of the knife 126 secured to the knife holder 130A or 130B.

The knife holder 130A of FIG. 9A has a blunt leading edge 146A as a result of the different surface contours of its registration surface 142A and knife seat 144A. In contrast, the registration surface 142B of the knife holder 130B of FIG. 9B does not have a simple arcuate shape, but instead is shaped to define a pattern complementary to that of the corrugated knife 126. The shapes of the registration surface 142B and knife seat 144B of the knife holder 130B are in phase, such that the leading edge 146B is sharp and substantially of constant thickness, in contrast to the periodically varying thickness that can be seen on the leading edge 146A of the knife holder 130A of FIG. 9A. In the nonlimiting examples of FIGS. 9A and 9B, the patterns of peaks and valleys on the knife 126, registration surface 142B, and knife seats 144A and 144B are periodic, e.g., substantially sinusoidal, although irregular patterns are also within the scope of the invention.

In investigations leading to the present invention, the periodic pattern of peaks and valleys on the knife seat 144A of the knife holder 130A of FIG. 9A provided immediate improvements in both knife position retention and solids accumulation relative to the knife holder 30 depicted in FIGS. 5, 7 and 8. The knife holder 130B shown in FIG. 9B, further modified to have the periodic pattern seen on its registration surface 142B, was concluded to further reduce solids accumulation by reducing scraping of products that might otherwise occur as a result of the blunt leading edge 146A of the knife holder 130A of FIG. 9A formed by the simple arcuate shape of its registration surface 142A.

Figure 10:
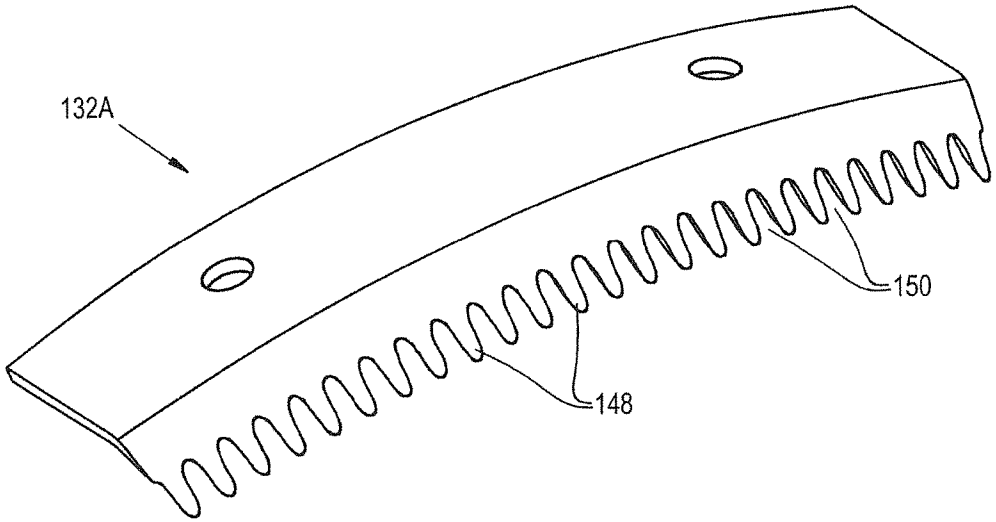
FIG. 10 represents a knife clamp suitable for use with the knife holders of FIGS. 9A and 9B.

FIG. 10 represents a knife clamp 132A adapted to be assembled with either of the knife holders 130A and 130B of FIGS. 9A and 9B to clamp a corrugated knife thereto, for example, the knife 126 mated with the knife seat 144B of the knife holder 130B in FIG. 9B. The knife clamp 132A shown in FIG. 10 is fabricated to have "fingers" 148 that are preferably, though not necessarily, capable of multiple purposes. For example, the fingers 148 may be used to at least partially close openings or gaps between the clamp 132A and a corrugated knife (e.g., 126) that are present as a result of valleys in the surface 131 of the knife 126, thereby reducing solids accumulation in the gaps. For this purpose, the fingers 148 sufficiently protrude into the valleys in the surface 131 facing the clamp 132A to close the openings to the gaps that exist between the knife 126 and clamp 132A. Alternatively or in addition, the fingers 148 may improve the stability of the leading edge of the knife 126 by reducing the cantilevered beam length of the knife 126, which as used herein refers to the length or distance between the cutting edge 127 of the knife 126 and the nearest adjacent extremity of the clamp 132A applying a clamping load to the knife 126. In this case, the nearest adjacent extremity of the clamp 132A is defined by the distal ends of the fingers 148, which physically engage the surface 131 of the knife 126 within the valleys facing the clamp 132A. The fingers 148 and resulting notches or recesses 150 therebetween define a pattern (e.g., a periodic pattern) complementary to the pattern of the knife 126 secured with the clamp 132A to the knife holder 130A or 130B.

Figure 11:
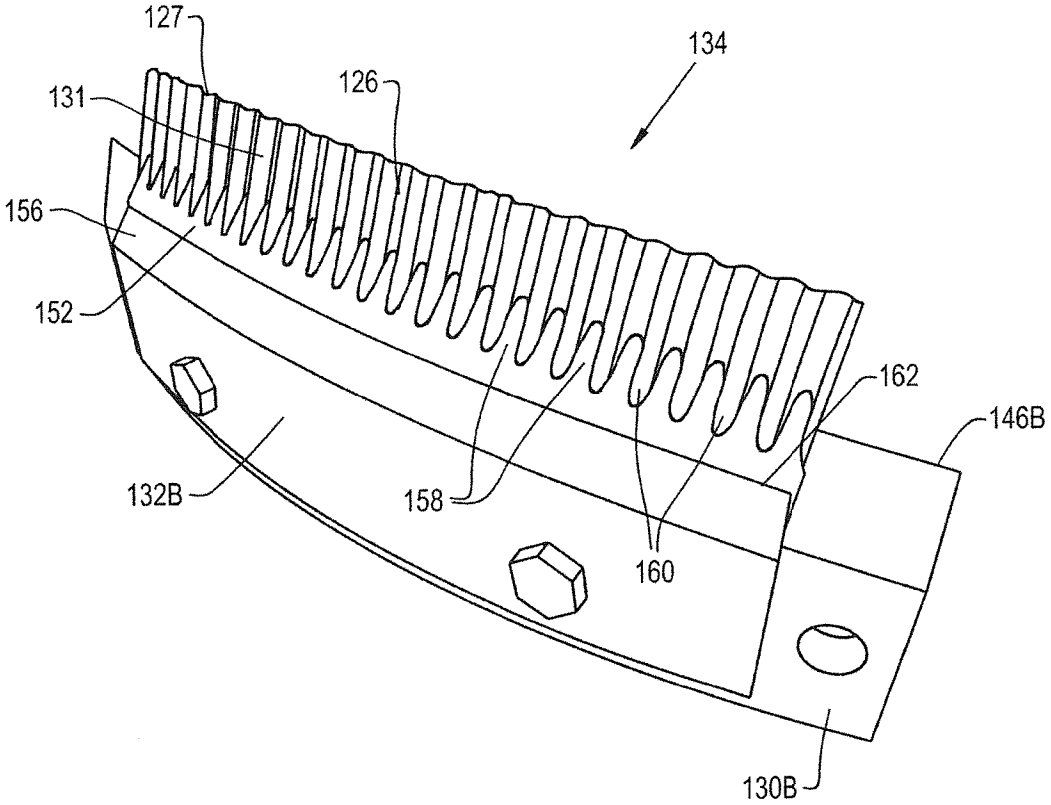
FIG. 11 is an image showing a knife assembly comprising the knife and knife holder of FIG. 9B, an adapter, and a knife clamp that clamps the knife and adapter to the knife holder.

As an alternative to the knife clamp 132A of FIG. 10, FIG. 11 shows the knife assembly 134 as comprising a corrugated knife 126, the knife holder 130B of FIG. 9B, a knife clamp 132B similar to the clamp 32 represented in FIGS. 5, 7 and 8, and an adapter 152 clamped to the knife holder 130B between the clamp 132B and knife 126. Similar to the clamp 32 described in reference to FIGS. 6 and 7, the clamp 132B depicted in FIG. 11 has a tapered outer leading surface 156 at its leading edge (generally conical as a result of the arcuate shape of the clamp 132B). Similar to the clamp 132A seen in FIG. 10, the adapter 152 is fabricated to have fingers 158 that, in combination with notches or recesses 160 therebetween, define a periodic pattern complementary to the periodic pattern in the surface 131 of the corrugated knife 126 mated with the adapter 152. The adapter 152 of FIG. 11 preferably mates tightly with the surface 131 of the knife 126 so that its fingers 158 at least partially close gaps between the leading edge 162 of the clamp 132B and the valleys on the surface 131 of the knife 126 defined by the corrugated shape of the knife 126. In combination, the knife holder 130B and adapter 152 cooperate to prevent or at least reduce the accumulation of solids within the valleys present in the surface 131 of the knife 126 beneath the clamp 132B. As such, the adapter 152 serves to eliminate the need to fabricate the clamp 132B to have fingers. The adapter 152 preferably defines a conical outer leading surface that effectively serves as an extension of the conical outer leading surface 156 of the clamp 132B so that, as discussed in relation to the clamp 32 of FIGS. 5, 7 and 8, slices are gently directed up and over the clamp 132B to reduce or eliminate scraping of the slices.

Consistent with FIGS. 9A and 9B, the knife seat 144B (not visible) of the knife holder 130B is preferably formed to have a periodic pattern that is complementary with the surface 129 of the corrugated knife 126 to substantially or entirely eliminate openings or gaps therebetween that would otherwise result from the valleys on the knife surface 129.

The adapter 152 depicted in FIG. 11 can be fabricated using rapid manufacturing and rapid prototyping technologies, for example, stereolithographically fabricated by 3-D printing stereolithography (SLA) resins directly from a CAD model of the adapter 152. Because SLA resins are typically brittle, non-food grade, and hygroscopic, another alternative is to cast the adapter 152 from a food-grade material, for example, urethane. The adapter 152 can also be fabricated from other materials, for example, stainless steel, and fabricated using more traditional manufacturing methods. The use of a hardened stainless steel can result in a stronger adapter 152 that is better able to assist the clamp 132B in stabilizing the knife 126 by helping to generate a greater clamping force. The use of various other materials and nontraditional manufacturing methods are also foreseeable in the fabrication of the adapter 152 disclosed herein.

It is also within the scope of the invention that a knife holder 130B of the type shown in FIG. 9B could be sufficiently sharpened to serve as a corrugated knife 126, eliminating the need for a separate knife 126, clamp 132B, and adapter 152 and thereby inherently avoiding the tendency for solids to accumulate within the valleys present in the surfaces 129 and 131 of the knife 126 as a result of its corrugated shape.

While the invention has been described in terms of specific embodiments, it is apparent that other forms could be adopted by one skilled in the art. For example, the knives 126, knife holders 130A and 130B, clamps 132A and 132B, and adapter 152 could differ in appearance and construction from the embodiments shown in the drawings and used with machines, impeller assemblies, and cutting heads that differ in appearance and construction from what is shown in the drawings, certain functions of their components could be performed by components of different construction but capable of a similar (though not necessarily equivalent) function, and various materials and processes could be used to fabricate the knife assemblies and their components. In addition, the invention encompasses additional embodiments in which one or more features or aspects of different disclosed embodiments may be combined. Though the non-limiting embodiments of the cutting heads shown in the drawings are particularly adapted to cut food products into slices, it is foreseeable that the impeller assemblies could be used in combination with cutting heads adapted for slicing other materials. Therefore, the scope of the invention is to be limited only by the following claims.

The invention claimed is:

1. A knife assembly of a slicing machine adapted to slice products, the knife assembly comprising:

a corrugated knife having oppositely-disposed first and second surfaces terminating at a cutting edge, the cutting edge and at least portions of the first and second surfaces adjacent thereto being characterized by a pattern of peaks and valleys;

a knife holder having a registration surface and an oppositely-disposed knife seat mated with the first surface of the corrugated knife, the knife seat comprising a pattern of peaks and valleys complementary to the pattern of peaks and valleys in the first surface of the corrugated knife, the knife holder having a leading edge beyond which the corrugated knife and the cutting edge thereof project; and means for securing the corrugated knife to the knife seat of the knife holder, the securing means comprising a member contacting the second surface of the corrugated knife, the member having fingers and notches therebetween that define a pattern complementary to the pattern of peaks and valleys in the second surface of the corrugated knife, the fingers engaging the valleys on the second surface of the corrugated knife and protruding beyond the leading edge of the knife holder to reduce a cantilevered beam length of the corrugated knife;

wherein the knife holder and the securing means cooperate to inhibit accumulation of solids of the products along at least one of the first and second surfaces of the corrugated knife.

2. The knife assembly of claim 1, wherein the corrugated knife is stabilized as a result of the cantilevered beam length of the corrugated knife being reduced by the fingers of the member.

3. The knife assembly of claim 1 wherein the member is a clamp that secures the corrugated knife to the knife seat of the knife holder.

4. The knife assembly of claim 1, wherein the securing means further comprises a clamp that secures the member and the corrugated knife to the knife seat of the knife holder, and the member is an adapter between the clamp and the corrugated knife.

5. The knife assembly of claim 4, wherein the fingers substantially or entirely close openings or gaps under an edge of the clamp resulting from the valleys on the second surface of the corrugated knife.

6. The knife assembly of claim 1, wherein the pattern of peaks and valleys of the corrugated knife is a periodic pattern.

7. The knife assembly of claim 1, wherein the registration surface of the knife holder comprises a pattern of peaks and valleys complementary to the pattern of peaks and valleys in the first surface of the corrugated knife.

8. The knife assembly of claim 1, wherein the knife assembly is secured to a segment of a cutting head.

9. The knife assembly of claim 1, wherein the slicing machine utilizes the knife assembly and at least a second knife assembly to produce slices or chips of a lattice type.

10. A knife assembly comprising:

a corrugated knife having oppositely-disposed first and second surfaces terminating at a cutting edge, the cutting edge and at least portions of the first and second surfaces adjacent thereto being characterized by a pattern of peaks and valleys;

a knife holder having a registration surface and an oppositely-disposed knife seat mated with the first surface of the corrugated knife, the knife seat comprising a pattern of peaks and valleys complementary to the pattern of peaks and valleys in the first surface of the corrugated knife, the knife holder having a leading edge beyond which the corrugated knife and the cutting edge thereof project; and means for securing the corrugated knife to the knife seat of the knife holder, the securing means comprising a member having fingers and notches therebetween that define a pattern complementary to the pattern of peaks and valleys in the second surface of the corrugated knife, the fingers of the member engaging the valleys on the second surface of the corrugated knife and protruding beyond the leading edge of the knife holder to reduce a cantilevered beam length of the corrugated knife.

11. The knife assembly of claim 10, wherein the pattern of peaks and valleys of the corrugated knife is a periodic pattern.

12. The knife assembly of claim 10, wherein the registration surface of the knife holder comprises a pattern of peaks and valleys complementary to the pattern of peaks and valleys in the first surface of the corrugated knife.

13. The knife assembly of claim 10, wherein the member is a clamp that secures the corrugated knife to the knife seat of the knife holder.

14. The knife assembly of any one claim 10, wherein the securing means further comprises a clamp that secures the member and the corrugated knife to the knife seat of the knife holder, and the member is an adapter between the clamp and the corrugated knife.

15. The knife assembly of claim 14, wherein the fingers of the member substantially or entirely close openings or gaps under an edge of the clamp resulting from the valleys on the second surface of the corrugated knife.

16. The knife assembly of claim 10, wherein the knife assembly is secured to a segment of a cutting head.

17. A method comprising using the knife assembly of claim 10 to produce slices or chips of a lattice type.

18. A knife assembly of a slicing machine adapted to slice products, the knife assembly comprising:

a corrugated knife having oppositely-disposed first and second surfaces terminating at a cutting edge, the cutting edge and at least portions of the first and second surfaces adjacent thereto being characterized by a pattern of peaks and valleys;

a knife holder having a registration surface and an oppositely-disposed knife seat mated with the first surface of the corrugated knife, the knife seat and the registration surface each comprising a pattern of peaks and valleys complementary to the pattern of peaks and valleys in the first surface of the corrugated knife, the knife holder having a leading edge beyond which the corrugated knife and the cutting edge thereof project, the patterns of peaks and valleys of the knife seat and the registration surface causing the leading edge to be sharp and have a substantially constant thickness; and means for securing the corrugated knife to the knife seat of the knife holder, the securing means having fingers and notches therebetween that contact the second surface of the corrugated knife, distal ends of the fingers defining nearest adjacent extremities of the securing means to the cutting edge of the corrugated knife;

wherein the knife holder and the securing means cooperate to inhibit accumulation of solids of the products along at least one of the first and second surfaces of the corrugated knife.

19. A slicing machine for slicing products, the slicing machine comprising:

a cutting head having an annular shape that defines an axis of the cutting head, the cutting head having at least one knife assembly having a corrugated knife oriented axially at a perimeter of the cutting head and extending radially inward into an interior of the cutting head, the corrugated knife having oppositely-disposed first and second surfaces terminating at a cutting edge, the cutting edge and at least portions of the first and second surfaces adjacent thereto being characterized by a pattern of peaks and valleys; and an impeller assembly coaxially mounted within the interior of the cutting head for rotation about the axis of the cutting head in a rotational direction relative to the cutting head, the impeller assembly comprising means for delivering products within the interior of the impeller assembly toward the perimeter of the cutting head as the impeller assembly rotates within the cutting head, the delivering means rotating about an axis thereof so that products within the delivering means rotate about axes thereof while the impeller assembly rotates about the axis of the cutting head;

wherein the knife assembly further comprises:

a knife holder having a registration surface and an oppositely-disposed knife seat mated with the first surface of the corrugated knife, the knife seat and the registration surface each comprising a pattern of peaks and valleys complementary to the pattern of peaks and valleys in the first surface of the corrugated knife, the knife holder having a leading edge beyond which the corrugated knife and the cutting edge thereof project, the patterns of peaks and valleys of the knife seat and the registration surface causing the leading edge to be sharp and have a substantially constant thickness; and means for securing the corrugated knife to the knife seat of the knife holder, the securing means having fingers and notches therebetween that contact the second surface of the corrugated knife, distal ends of the fingers defining nearest adjacent extremities of the securing means to the cutting edge of the corrugated knife;

wherein the knife holder and the securing means cooperate to:

inhibit accumulation of solids of the products along at least one of the first and second surfaces of the corrugated knife; and/or stabilize the corrugated knife by reducing a cantilevered beam length of the corrugated knife.

20. A slicing machine for slicing products, the slicing machine comprising:

a cutting head having an annular shape that defines an axis of the cutting head, the cutting head having at least one knife assembly having a corrugated knife oriented axially at a perimeter of the cutting head and extending radially inward into an interior of the cutting head, the corrugated knife having oppositely-disposed first and second surfaces terminating at a cutting edge, the cutting edge and at least portions of the first and second surfaces adjacent thereto being characterized by a pattern of peaks and valleys; and an impeller assembly coaxially mounted within the interior of the cutting head for rotation about the axis of the cutting head in a rotational direction relative to the cutting head, the impeller assembly comprising means for delivering products within the interior of the impeller assembly toward the perimeter of the cutting head as the impeller assembly rotates within the cutting head, the delivering means rotating about an axis thereof so that products within the delivering means rotate about axes thereof while the impeller assembly rotates about the axis of the cutting head;

wherein the knife assembly further comprises:

a knife holder having a registration surface and an oppositely-disposed knife seat mated with the first surface of the corrugated knife, the knife seat comprising a pattern of peaks and valleys complementary to the pattern of peaks and valleys in the first surface of the corrugated knife, the knife holder having a leading edge beyond which the corrugated knife and the cutting edge thereof project; and means for securing the corrugated knife to the knife seat of the knife holder, the securing means comprising a member contacting the second surface of the corrugated knife, the member having fingers and notches therebetween that define a pattern complementary to the pattern of peaks and valleys in the second surface of the corrugated knife, the fingers engaging the valleys on the second surface of the corrugated knife and protruding beyond the leading edge of the knife holder to reduce a cantilevered beam length of the corrugated knife;

wherein the knife holder and the securing means cooperate to:

inhibit accumulation of solids of the products along at least one of the first and second surfaces of the corrugated knife; and/or stabilize the corrugated knife by reducing a cantilevered beam length of the corrugated knife.

21. The slicing machine of claim 20, wherein the member is a clamp that secures the corrugated knife to the knife seat of the knife holder.

22. The slicing machine of claim 20, wherein the securing means further comprises a clamp that secures the member and the corrugated knife to the knife seat of the knife holder, and the member is an adapter between the clamp and the corrugated knife.

23. The slicing machine of claim 22, wherein the fingers of the member substantially or entirely close openings or gaps under an edge of the clamp resulting from the valleys on the second surface of the corrugated knife.

24. The slicing machine of claim 20, wherein the delivering means comprises a plurality of tubular guides that rotate about respective axes thereof.

25. The slicing machine of claim 20, wherein the pattern of peaks and valleys of the corrugated knife is a periodic pattern.

26. The slicing machine of claim 20, wherein the registration surface of the knife holder comprises a pattern of peaks and valleys complementary to the pattern of peaks and valleys in the first surface of the corrugated knife.

27. A method comprising using the slicing machine of claim 20 to produce slices or chips of a lattice type.

28. The method of claim 27, the method comprising:

rotating the impeller assembly;

supplying products to the impeller assembly;

delivering the products to the perimeter of the cutting head through action of rotating the impeller assembly and the delivering means; and slicing the products with the corrugated knife to produce the slices or chips of the lattice type.

29. The method of claim 27, wherein the products are food products.

* * * * *